United States Patent [19]

Urano et al.

[11] Patent Number: 4,505,988

[45] Date of Patent: Mar. 19, 1985

[54] SINTERED ALLOY FOR VALVE SEAT

[75] Inventors: Shigeru Urano, Saitama; Kiyoshi Yamamoto, Chiba; Yoshiaki Takagi; Takeshi Sugawara, both of Saitama, all of Japan

[73] Assignees: Honda Piston Ring Co., Ltd.; Honda Giken Kogyo Kabushiki Kaisha, both of Tokyo, Japan

[21] Appl. No.: 518,262

[22] Filed: Jul. 28, 1983

[30] Foreign Application Priority Data

Jul. 28, 1982 [JP] Japan ..... 57-131556

[51] Int. Cl.[3] ..... B22F 3/26; B22F 5/00

[52] U.S. Cl. ..... 428/569; 75/243; 75/246; 251/359; 419/27; 428/567

[58] Field of Search ..... 75/243, 246; 251/359; 419/27; 428/567, 569

[56] References Cited

U.S. PATENT DOCUMENTS 4,123,265 10/1978 Takahashi et al. ..... 419/27
4,363,662 12/1982 Takahashi et al. ..... 75/246
4,424,953 1/1984 Takagi et al. ..... 123/188 S

FOREIGN PATENT DOCUMENTS 1580687 12/1980 United Kingdom ..... 419/27

*Primary Examiner*—Leland A. Sebastian
*Attorney, Agent, or Firm*—Sughrue, Mion, Zinn, Macpeak & Seas

[57] ABSTRACT

A sintered alloy for a valve seat comprising, in weight percent, 0.5 to 1.7% C, 0.5 to 2.5% Ni, 3.0 to 8.0% Cr, 0.1 to 0.9% Mo, 1.0 to 3.8% W and 4.5 to 8.5% Co, the balance being substantially Fe provided by a base atomized powder; said alloy containing 8 to 14% by volume of 250 mesh or less C-Cr-W-Co-Fe and Fe-Mo hard grains and 6 to 13% by volume of cells, with the continuous cells being infiltrated by a copper alloy.

4 Claims, 7 Drawing Figures

(x200)

(x200)

(x200)

SINTERED ALLOY FOR VALVE SEAT

BACKGROUND OF THE INVENTION

The present invention relates to a sintered alloy for use in a valve seat for an intake/exhaust valve of an internal combustion engine.

Valve seats made of sintered alloys have been widely used in internal combustion engines because of their superior wear resistance since the advent of lead-free gasoline. However, the presence of sinter cells or pores which contribute to the superior wear resistance of a valve seat formed of such a sintered alloy presents problems with respect to the strength of the valve seat. These cells or pores can be continuous or closed and hereinafter are referred to as "cells".

When a valve seat is mounted on a cylinder head of an aluminum alloy by techniques such as shrinkage-fit, expansion fit, or by application of pressure, the valve seat is prevented from dropping from the cylinder head as long as the valve seat has an appropriate thickness. When, however, the valve open area of the cylinder head is increased in order to increase the engine output, it is necessary to decrease the thickness of the valve seat. In this case, problems such as dropping or deformation of the valve seat inevitably develop. In engines such as a Diesel engine in which a head made of cast iron is used, the difference in coefficient of thermal expansion between the valve seat and the cast iron cylinder head may sometimes cause the problem of valve seat dropping.

In the case of a valve seat to be mounted at the exhaust side, infiltration with a copper alloy, which serves to increase thermal conductivity and to seal cells, is at times used for the purposes of decreasing accumulation of heat due to exhaust gas and for increasing valve seat strength.

In making such a sintered alloy material, hard grains and cells are dispersed in a base structure of an iron-base alloy. As these hard grains, Fe-Mo and stellite alloy grains are most widely used. An oxide coating is formed in the cells, and wear resistance is increased by the synergistic effect of the hard grains and cells. In general, therefore, the amount of hard grains is about 20% by volume, and the amount of cells is about 15% by volume. Since sintered alloy valve seats are described in, for example, Japanese Patent Publication Nos. 13093/76 and 44947/81. In conventional sintered alloy valve seats, although the wear resistance is good, strength and rigidity are poor since the amount of cells and the amounts of hard grains are large. Thus, it is considered that there is a problem of the valve seat dropping. When infiltration of a copper alloy is applied, for the purpose of increasing strength, the amount of copper used for infiltration is high due to the large amount of cells present. Thus, owing to the difference in coefficient of thermal expansion between the sintered alloy and the infiltrated copper alloy, the rigidity and strength of the valve seat deteriorate when the valve is subjected to a cycle of heating and cooling at high temperature. Furthermore, wear resistance is reduced.

SUMMARY OF THE INVENTION

The prime object of the invention is to provide a sintered alloy for a valve seat characterized by increased rigidity and strength while retaining the wear resistance of conventional sintered alloys used for valve seats. Other objects of this invention will be apparent to the skilled artisan.

The sintered alloy of this invention comprises, as expressed in weight percent, 0.5 to 1.7% C, 0.5 to 2.5% Ni, 3.0 to 8.0% Cr, 0.1 to 0.9% Mo, 1.0 to 3.8% W, and 4.5 to 8.5% Co, the balance being substantially Fe;

contains 8 to 14% by volume of 250 mesh or less C—Cr—W—Co—Fe and Fe—Mo grains;

possesses a base structure formed using an atomized powder;

contains 6 to 13% by volume of continuous and closed cells;

and the continuous cells are substantially infiltrated with a copper alloy.

The most significant feature of the sintered alloy for a valve seat as disclosed herein is that the amount of cells and the amount of copper being infiltrated, the latter being controlled by the amount of cells, are set to optimum levels by controlling the size and amount of powder to be used to form the base and hard grains. In this manner, therefore, strength and rigidity are superior to the conventional sintered alloys of this type used for valve seats.

Figure 1:
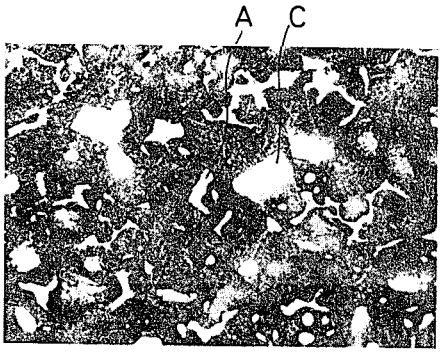
FIG. 1 is a photomicrograph (200x) showing the metal structure of the sintered alloy of the present invention used in a valve seat.
Figure 2:
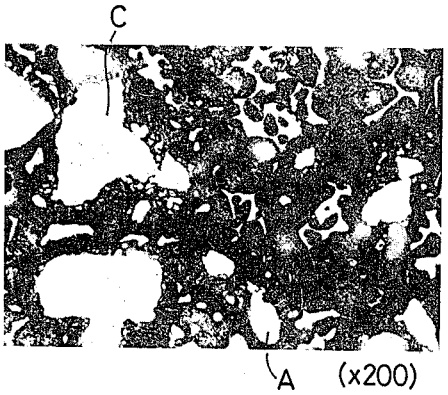
FIG. 2 is a photomicrograph (200x) showing the metal structure of a conventional sintered alloy as used in a valve seat.

The symbols used in FIGS. 1 and 2 are as follows:

A: Cells in infiltrated copper

B: Hard grains

DETAILED DESCRIPTION OF THE INVENTION

In the first place, the composition of the sintered alloy for a valve seat of this invention will be explained.

C is an element required for adjusting the base and also for forming C—Cr—W—Co—Fe grains. When the C content is less than 0.5%, the amount of ferrite in the base is excessive, resulting in a decrease in the strength of the base and further in a shortage of the amount of hard grains. On the other hand, when the C content is more than 1.7%, the amount of cementite in the base is excessive, resulting in a reduction in cutting properties and further in a decrease in strength. It is, therefore, required for the C content to be within the range of 0.5 to 1.7% and preferably 1.0 and 1.5%.

Ni is added as a Ni powder and is soluble in the base, serving to increase heat resistance. When the Ni content is less than 0.5%, increased heat resistance is not obtained. On the other hand, when Ni content exceeds 2.5%, hardening properties deteriorate. It is therefore required for the Ni content to be chosen within the range of 0.5 to 2.5%, preferably 0.8 to 2.3%.

Cr is added as a C—Cr—W—Co—Fe alloy powder and contributes to wear resistance as C—Cr—W—Co—Fe hard grains. When the Cr content is less than 3.0%, the amount of hard grains is too small. Therefore, wear resistance is not satisfactory and furthermore heat resistance is poor. On the other hand, when the Cr content exceeds 8.0%, the amount of hard grains is too large. This leads to a reduction in strength as described hereinafter. Thus, it is necessary that the Cr content should be chosen within the range of 3.0 to 8.0%, preferably 3.5 to 7.5%.

Co is added as a C—Cr—W—Co—Fe alloy powder and also as a Co powder and contributes to wear resistance as C—Cr—W—Co—Fe grains. Furthermore, it is present around the C—Cr—W—Co—Fe grains, serving to strongly bind the grains to the base. Further, it is soluble in the base, contributing to improved heat resistance. When the Co content is less than 4.5%, the foregoing effects cannot be sufficiently obtained. On the other hand, when Co content exceeds 8.5%, excessive amounts of the hard grains are present, causing a reduction in strength as described hereinafter. Thus, it is necessary that the Co content be within the range of 4.5 to 8.5%, preferably 5.0 to 8.0%.

W is added as a C—Cr—W—Co—Fe alloy powder which forms C—Cr—W—Co—Fe grains, contributing to increased wear resistance. In lesser amounts than 1.0%, the foregoing effect cannot be obtained, whereas in greater amounts than 3.8%, as described hereinafter, the hard grains are excessively formed, resulting in a decrease in strength. It is therefore necessary for the W content to be within the range of 1.0 to 3.8%, preferably 1.3 to 3.3%.

Mo is added as an Fe—Mo powder or a low carbon content Fe-Mo powder, and forms Fe—Mo grains contributing to increased wear resistance, as with the C—Cr—W—Co—Fe grains. When the Mo content is less than 0.1%, the amount of Fe—Mo grains contributing to the wear resistance is too small, and the stability of the structure after sintering is deteriorated. On the other hand, when Mo content is more than 0.9%, the amount of the hard grains is too large, leading to a reduction in strength. It is therefore necessary for the Mo content to be within the range of 0.1 to 0.9%, preferably 0.3 to 0.7%.

The sintered alloy of the present invention for a valve seat has the foregoing composition. It is further essential that the amount of cells should be from 6 to 13% by volume of the alloy, the hard grains are 250 mesh or less in grain size and constitute from 8 to 14% by volume of the alloy, and that the base is formed from an atomized powder.

In order to increase the strength and ridigity of a sintered alloy, the artisan attempts to increase the density of the sintered alloy. If, however, sinter forging or liquid phase sintering is applied for that purpose, most of the resulting sinter pores or cells are closed ones and, therefore, infiltration of the sinter pores or cells cannot be achieved. Although density can be increased merely by using an atomized powder, since the atomized powder is nearly spherical in shape, such closed cells are easily formed.

In accordance with the present invention, the C—Cr—W—Co—Fe hard grains and the Fe—Mo grains are each added as a 250 mesh or less powder, the amount of the hard grains is controlled to 8 to 14% by volume, and further the iron powder forming the base is used in the form of atomized powder. These factors in combination are believed to enable adjustment of the amount of cells to 6 to 13% by volume with the amount of closed cells at 0.4 to 1.2% by volume.

The amount of cells is closely related to the strength and rigidity of the sintered alloy itself. When the amount of cells exceeds 13% by volume, the strength and rigidity of the sintered alloy itself seriously decrease, and furthermore, the cells are excessively infiltrated, resulting in a reduction in strength at high temperatures. That is, there is a great difference in coefficient of thermal expansion between the copper alloy infiltrated into the cells and the sintered alloy itself, which is responsible for a reduction in the strength of a valve seat subjected to a high temperature heating-cooling cycle. It is therefore necessary that the amount of cells to be infiltrated with a copper alloy should be 13% or less. The sintered alloy material contains about 9.5 to 14.0% weight of Cu, after infiltration, in the continuous cells.

On the other hand, when the amount of cells is as low as about less than 6%, the proportional amount of closed cells not infiltrated with the copper alloy increases. Then, the infiltration amount is too small, and the coefficient of thermal conductivity is not increased. It is therefore necessary that the amount of cells should be within the range of from 6 to 13% by volume.

With regard to the amount of closed cells not infiltrated with the copper alloy, it is preferable that they be present from 0.4 to 1.2% by volume. In amounts greater than 1.2%, the amount of closed cells not infiltrated with the copper alloy is too large, leading to decreases in strength, rigidity, and coefficient of thermal conductivity. On the other hand, in amounts less than 0.4%, the amount of closed cells is too small. This leads to a drop in strength at high temperatures because the closed cells have the function of controlling the reduction in strength at high temperatures due to the difference in coefficient of thermal expansion between the infiltrated layer and the sintered alloy. Thus, the amount of closed cells is within the range of from 0.4 to 1.2%.

In order to control both the total amount of cells and the amount of closed cells within the above-described ranges, it is necessary that the C—Cr—W—Co—Fe and Fe—Mo hard grains be 250 mesh or less in size and constitute 8 to 14% by volume of the alloy, and further that the base iron powder forming the base should be used in the form of an atomized powder.

When the hard grains are a coarse powder of more than 250 mesh, the press moldability of the mixed powder is reduced, and it is impossible to control the amount of cells within the above-described range of from 6 to 13%. Furthermore, if the hard grains in the sintered alloy are coarse, there is a reduction in wear resistance. Thus, it is necessary for the hard grains to be 250 mesh or less in size.

The hard grains are essential for increasing wear resistance. However, when the amount of the hard grains is less than 8% by volume, the wear resistance of the resulting sintered alloy is inferior, whereas when it is more than 14% by volume, the amount of hard grains relative to the base iron powder is too large, resulting in deterioration of the powder moldability and in an excess of the amount of formed sinter cells. Thus, it is necessary for the amount of the hard grains to be within the range of from 8 to 14% by volume.

It is necessary for the base iron powder used to be an atomized powder. Where the base iron powder contains from 8 to 14% by volume of 250 mesh or less size hard grains as described hereinafter, the amount of sinter cells can be controlled within the range of from 6 to 13% by volume only when the base iron powder is an atomized powder. The use of such an atomized powder permits fine and uniform distribution of sinter cells. The copper infiltration of the cells prevents reduction in strength of the valve seat at high temperatures.

If the atomized powder is used without the hard grains, the amount of closed cells usually increases to a relatively excess level. However, since the atomized powder is mixed with 8 to 14% by volume of hard grains as described hereinafter, the formation of such an excess amount of closed cells is prevented. Thus, a reduction in the amount of the closed cells which are not infiltrated with copper can be attained simultaneously with control in the total amount of sinter cells by using the atomized base powder with the defined hard grains.

The C—Cr—W—Co—Fe alloy hard grains are preferably made of an alloy comprising 2.0 to 3.0% C, 7.0 to 15% Co, 15 to 25% W, and 1.0 to 8.0% Fe, by weight, the balance being substantially Cr. This alloy powder is uniformly dispersed in the base structure of the sintered alloy, contributing to increased wear resistance. An overall composite carbide comprising a base of Fe—Co—Cr and a composite carbide composed mainly of W—Cr—C has a hardness exceeding Hv 1600 and is superior in wear resistance. Furthermore, this base structure is superior in heat resistance and corrosion resistance and readily forms an alloy of stabilized structure in combination with the iron-base sintering material.

C is essential for forming a composite carbide. When the C content is less than 2.0%, the amount of the carbide is too small, whereas when it is more than 3.0%, the carbide becomes coarse and its strength as an alloy powder grain is insufficient. Thus, the C content of the C—Cr—W—Co—Fe alloy grains is within the range of from 2.0 to 3.0%.

Co acts as a binder in dispersing the alloy grains in an iron-based sintering material. When the Co is less than 7.0%, the strength, corrosion resistance, and heat resistance are insufficient. On the other hand, even if Co is added in amounts exceeding 15%, no further effect can be obtained. Thus, Co content of the C—Cr—W—Co—Fe alloy grains is within the range of from 7 to 15%.

W is a major element for forming the carbide of the hard grains. When the W content is less than 15%, the amount of the carbide to be formed is small and the effect of increasing wear resistance cannot be obtained. Thus, W content of the C—Cr—W—Co—Fe alloy grains is within the range of from 15 to 25%.

Fe is contained in both the carbide of the hard grain and in the base, and accordingly, it serves not only to strengthen the bond between the carbide and the base, but also to facilitate the bonding of alloy grains to the iron-base sintered base material. When Fe is present in the hard grain in an amount less than 1.0%, the foregoing effects are not sufficiently obtained, whereas when Fe is added in amounts greater than 8.0%, the wear resistance and corrosion resistance of the alloy grains and base are deteriorated. Thus, Fe is present in an amount ranging between 1.0 and 8.0% in the C—Cr—W—Co—Fe alloy grains.

EXAMPLES

The examples and tests of the present invention are now explained.

Valve Seat Produced From Alloy of the Invention

To a powder composition consisting of:
C powder (-325 mesh): 1.2%
Co powder (5μ or less): 6.0%
Ni powder (-325 mesh): 2.0%
Fe—Mo powder (-250 mesh): 1.0%
C—Co—W—Cr—Fe (2.5:10:19:63.5:5) alloy powder (-250 mesh): 11.5%
the balance being an atomized iron powder, there was added 1% of zinc stearate to prepare a feed powder.

This feed powder was compact-molded into a valve seat at a pressure of 6 ton/cm$^2$, sintered at 1,110° C. for 60 minutes in a reducing atmosphere and, after mounting thereon a copper alloy for infiltration, was subject to an infiltration treatment at 1,130° C. for 60 minutes. It was further held at 880° C. for 30 minutes and, thereafter, was oil-quenched and annealed.

The physical values of the above-produced valve seat were measured.

Composition (% by weight)

Consisting of 1.20% C, 1.73% Ni, 7.30% Cr, 0.45% Mo, 2.19% W, and 7.15% Co, the balance being Fe containing traces of impurities, and containing 12.51% Cu in sinter cells.

Hardness

HRC 33.0

Porosity 11.8% (prior to infiltration)

Ratio of Closed Cells 0.51%

Modulus of Elasticity 19,400 kg/mm$^2$

Coefficient of Thermal Expansion (from room temperature to 400° C.) $1.244\times10^{-5}$ (/°C.)

Coefficient of Thermal Conductivity (400° C.)

$10.4\times10^{-2}$ cal/m-sec-°C.

Tensile Strength 96.8 kg/mm$^2$

With the sintered alloy valve seat of the invention, the tensile strength is as high as at least 90 Kg/mm$^2$, the modulus of elasticity is at least 17,000 kg/mm$^2$, and furthermore, the coeffcient of thermal conductivity is as high as at least $10\times10^{-2}$ cal/m-sec-°C.

The valve seat formed of the sintered alloy of the invention is compared with the following valve seats formed of conventional sintered alloys.

Comparative Valve Seat 1

This valve seat was produced by mold-sintering a mixed powder consisting of 0.75% C powder (-325 mesh), 1.2% Ni powder (-325 mesh), 0.8% Fe—Mo powder (-150 mesh), 18% C—Cr—W—Co (1.4:55:26:17.6) alloy powder (-150 mesh), and 5.5% Co powder, the balance being a reduced iron powder (-100 mesh), in the same manner as in the production of the valve seat of the invention.

Comparative Valve Seat 2

This valve seat was produced by applying an infiltration treatment on Comparative Valve Seat 1 under the same conditions as described for the production of the valve seat of the invention.

The physical values of the Comparative Valve Seats were measured, and the results were as follows:

| | Unit | Comparative Example 1 | Comparative Example 2 |
|---|---|---|---|
| Ratio of Cells | % by volume | 14.3 | 14.3 |
| Ratio of Closed Cells | % by volume | — | 0.31 |
| Modulus of Elasticity | $kg/mm^2$ | 12,000 | 16,000 |
| Coefficient of Thermal Expansion (room temperature to 400° C.) | /°C. | $1.11 \times 10^{-5}$ | $1.19 \times 10^{-3}$ |
| Coefficient of Thermal Conductivity (400° C.) | cal/m-sec-°C. | $4.3 \times 10^{-2}$ | $9.6 \times 10^{-2}$ |
| Tensile Strength | $kg/mm^2$ | 28 | 72 |

A comparison between the valve seat based on the alloy of the invention and Comparative Valve Seats 1 and 2 confirmed that the valve seat of the invention was very superior in respect of the modulus of elasticity and tensile strength. This is due to the fact that, as can be seen from a photomicrograph of the sintered alloy of the invention as used in a valve seat (etched in nital, 200x) as shown in FIG. 1 and a photomicrograph of the comparative material of the valve seat 2 (as measured under the same conditions as above) as shown in FIG. 2 in the sintered alloy for use in the valve seat of the invention, hard grains C are of fine size, and furthermore, sinter cells A infiltrated with copper are reduced in number and also are fine in size.

The valve seat made of the alloy of this invention and Comparative Valve Seats 1 and 2 were subjected to the tests as described hereinafter to demonstrate improvements to be obtained with the invention.

Test 1 (Test for fitting under pressure and dismantling of valve seat)

A cylinder head sample made of an aluminum alloy, corresponding to a cylinder head, which had an outer diameter of 86 mm and a height of 25 mm, and was bored to provide a valve seat fitting hole in the center thereof was force fitted under pressure with a valve seat while changing interference of the valve seat to the cylinder head sample, and the load at which the valve seat was fitted was used to evaluate the rigidity of the valve seat.

In this case, the valve seat of the invention and Comparative Seat 2, both being infiltrated, were each designed so that the outer diameter thereof was 31 mm, the inner diameter thereof was 25 mm, and the thickness thereof was 3 mm. With regard to Comparative Valve Seat 1 which was not subjected to an infiltration treatment, although the outer diameter was the same as above, the inner diameter was 23 mm and the thickness was 4 mm.

Then, the valve seat was heated at 400° C. for 3 minutes while cooling the outer periphery of the cylinder head sample with water and, thereafter, was air-cooled for 3 minutes by means of an air jet. This heating/cooling cycle was repeated 200 times. The load required for dismantling the valve seat from the cylinder head sample was measured and used to evaluate the dropping strength of the valve seat.

Results of Test 1

Figure 3:
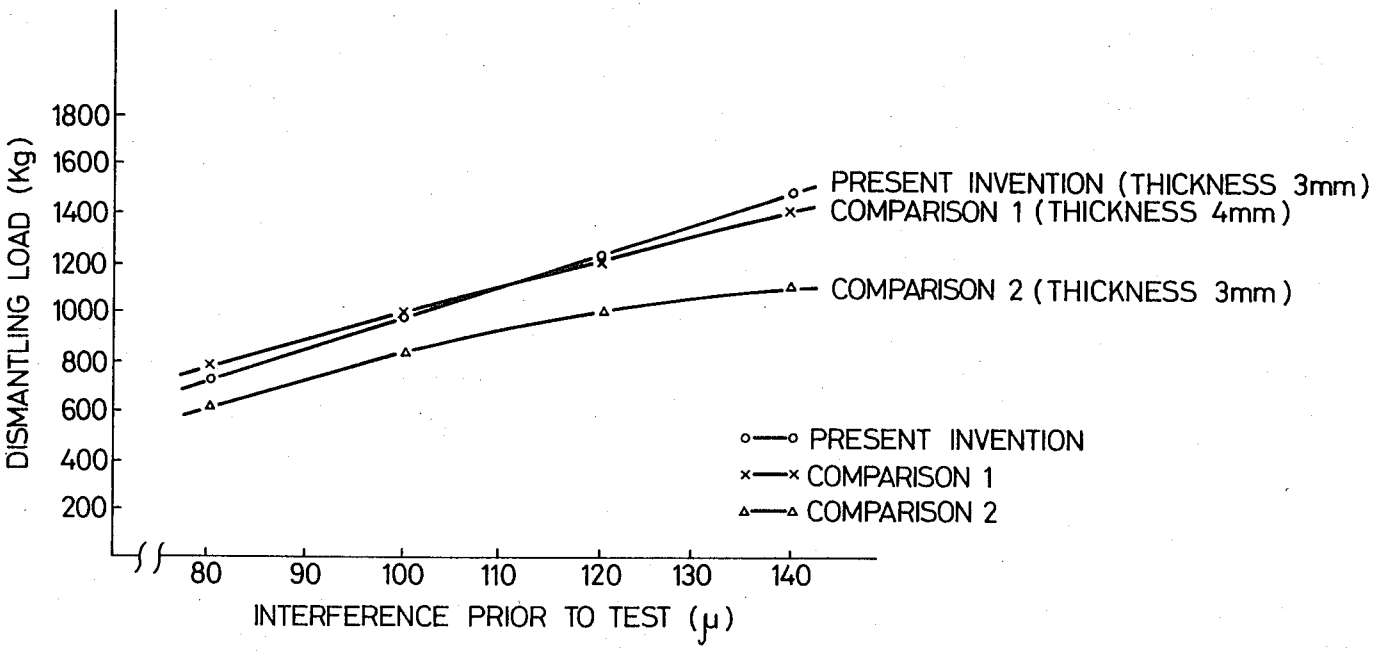
FIG. 3 is a graph plotting the results of a comparative test involving dismantling of a valve seat from a cylinder head.

FIG. 3 shows the test results illustrating the relation between the interference of the valve seat to the cylinder head sample and the dismantling load. As apparent from FIG. 3, the dismantling load of the valve seat based on the alloy of this invention is 1.3 times that of Comparative Valve Seat 3 which has been subjected to the same infiltration treatment as for the valve seat based on the invention, and is nearly equal to that of Comparative Valve Seat 1, which has not been subjected to any infiltration treatment but is about 1.3 times thicker than the valve seat using the alloy of the invention. Thus, it has been confirmed that the valve seat of the invention is superior in dropping strength.

Figure 4:
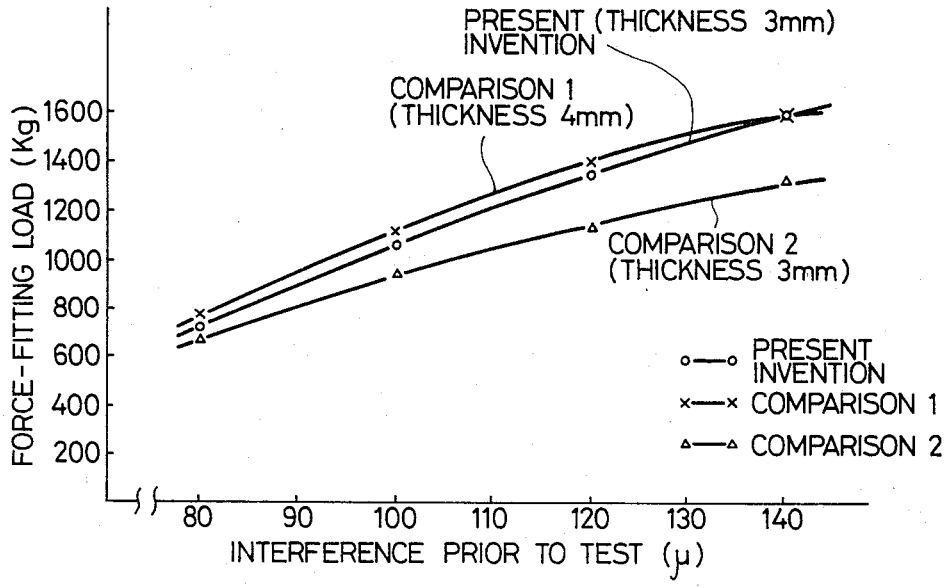
FIG. 4 is a graph plotting the results of a comparative test involving fitting under pressure a valve seat to a cylinder head.

FIG. 4 shows the results of the test of fitting under pressure the valve seat to the cylinder head sample. As shown in FIG. 4, the fitting load of the valve seat made of the alloy of the invention is about 1.2 times that of Comparative Valve Seat 2, and the fitting strength of the valve seat made of the alloy of the invention is nearly equal to that of Comparative Valve Seat 1 which is 1.3 times thicker than the valve seat made of the alloy of the invention. Thus, it has been confirmed that the valve seat of the alloy of the invention is superior in rigidity.

Test 2 (Wear Test)

The surface of the valve seat was heated at 300°-500° C. to determine wear at different temperatures within that range. While rotating the valve through a spring, $8 \times 10^5$ strokes were applied at a rate of 3,000 strokes per minute at a valve spring load of 35 kg. The worn surface areas of the valve seat and of the valve were measured and used to determine wear resistance. The valve used was a salvaged valve of Stellite No. 6.

Results of Test 2

Figure 5:
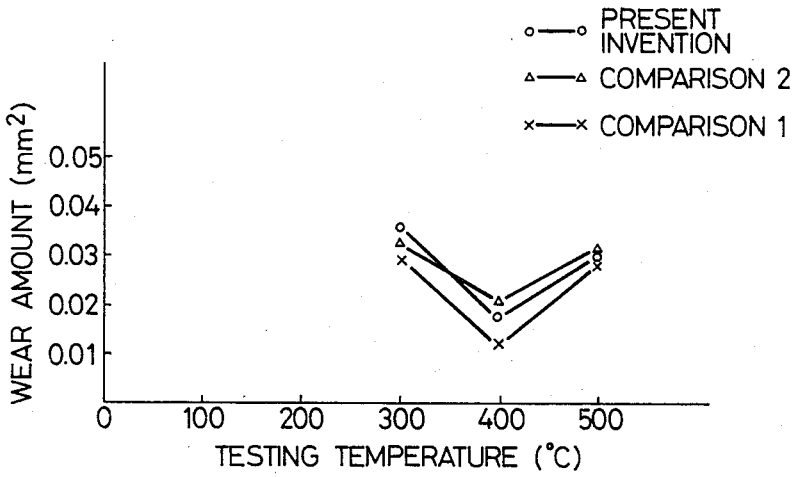
FIGS. 5 and 6 are graphs plotting comparative wear test results of valve seat and valve respectively.
Figure 6:
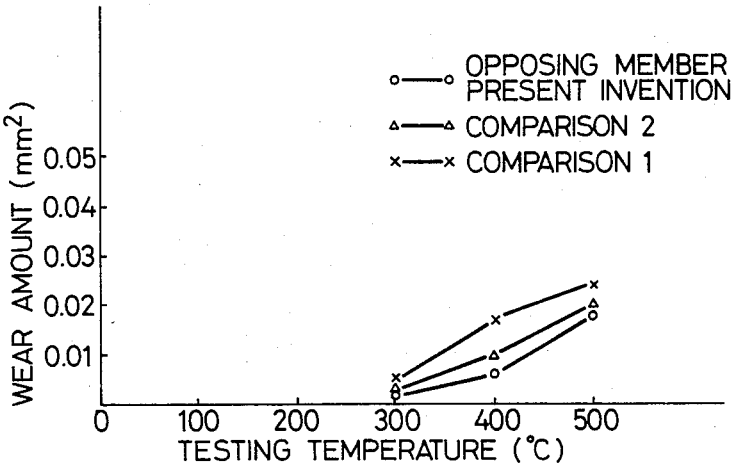

FIG. 5 plots the wear amount of the valve seat against the temperature, and FIG. 6 plots the wear amount of the valve against temperature.

As apparent from FIGS. 5 and 6, the valve seat based on the invention exhibits similar wear resistance to that of Comparative Valve Seats 1 and 2. Thus, it has been confirmed that the valve seat based on the alloy of this invention has satisfactory wear resistance.

Test 3 (Practical Test)

1,500 c.c. OHV gasoline engine
5,500 r.p.m. total load
400-hour continuous operation
Valve seat: The foregoing valve seat made of the alloy of this invention and Comparative Valve Seats 1 and 2.
Dimensions: Outer diameter = 31 mm, inner diameter = 23 mm, height = 7 mm
Valve: Valve of Stellite No. 6

Results of Test 3

After the above practical testing, dropping and deformation were not observed for any of the tested valve seats (based on the invention and Comparative Valve Seats 1 and 2).

Figure 7:
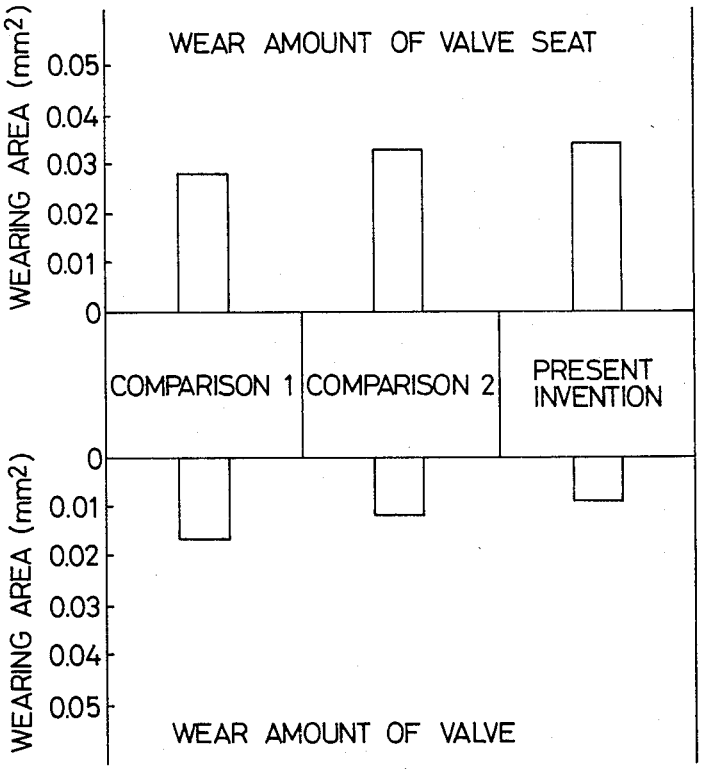
FIG. 7 is a graph plotting comparative wear test results of valve seat and valve according to a practical testing method.

The average worn amount of each of the valve seats and the valve used for each cylinder is shown in FIG. 7. From the wear test results of FIG. 7, it can be seen that the average worn amount of the valve seat based on the alloy of the invention was 0.04 $mm^2$ or less and, even if combined with the average worn amount of the valve, was 0.05 $mm^2$ or less. The worn amount of the valve seat of the invention is similar to that of Comparative Valve Seats 1 and 2, so that the valve seat based on the alloy of this invention is acceptable for practical use.

As described above, the valve seat made of the alloy of this invention is superior in strength and rigidity, and even if reduced in thickness or fitted to a cylinder head made of cast iron, holds sufficiently high dropping strength. Further, with regard to wear resistance, the valve seat made of the alloy of the invention exhibits similar wear resistance to that of conventional high alloy valve seats. The reasons for these are believed to involve, at least in part, that in the present invention sinter cells are suitably controlled so as to obtain the effect of copper alloy-infiltration, the structure containing hard grains in dense, and thermal conductivity and other measured properties are superior.

Variations of the invention will be apparent to the skilled artisan.

We claim:

1. A sintered alloy material for valve seats, in which hard grains are dispersed in a base structure and sintering cells are infiltrated with a copper alloy, which is characterized in that the sintered alloy comprises, as expressed in weight percent, 0.5 to 1.7% C, 0.5 to 2.5% Ni, 3.0 to 8.0% Cr, 0.1 to 0.9% Mo, 1.0 to 3.8% W, and 4.5 to 8.5% Co, the balance being substantially Fe provided by a base atomized powder, and contains 8 to 14% by volume of C—Cr—W—Co—Fe and Fe—Mo hard grains, both having a size of 250 mesh or less; the amount of cells formed using the atomized powder is 6 to 13% by volume, with an amount of closed cells of 0.4 to 1.2% by volume; and continuous ones of the cells are substantially infiltrated with the copper alloy.

2. A sintered alloy material as claimed in claim 1, wherein the sintered alloy comprises 1.0 to 1.5% C, 0.8 to 2.3% Ni, 3.5 to 7.5% Cr, 0.3 to 0.7% Mo, 1.3 to 3.3% W, and 5.0 to 8.0% Co, the balance being substantially Fe, and the cells contain 9.5 to 14.0% Cu.

3. A sintered alloy material as claimed in claim 2, wherein the C—Cr—W—Co—Fe grains comprise, as expressed in weight percent, 2.0 to 3.0% C, 7.0 to 15% Co, 15 to 25% W, and 1.0 to 8.0% Fe, the balance being substantially Cr.

4. A valve seat for an intake/exhaust valve of an internal combustion engine formed of the sintered alloy of claim 1.

* * * * *

UNITED STATES PATENT AND TRADEMARK OFFICE

CERTIFICATE OF CORRECTION

PATENT NO. : 4,505,988

DATED : March 19, 1985

INVENTOR(S) : Urano et al

It is certified that error appears in the above—identified patent and that said Letters Patent is hereby corrected as shown below:

Title page:

The assignees should read as follows:

-- Nippon Piston Ring Co., Ltd.;
Honda Giken Kogyo Kabushiki Kaisha,
both of Tokyo, Japan --.

Signed and Sealed this

*Eighteenth* Day of *March 1986*

[SEAL]

*Attest:*

DONALD J. QUIGG

*Attesting Officer*

*Commissioner of Patents and Trademarks*